US005907339A

United States Patent [19]

Evans et al.

[11] Patent Number: 5,907,339

[45] Date of Patent: May 25, 1999

[54] INK JET PRINTHEAD HAVING SOLENOIDS CONTROLLING INK FLOW

[75] Inventors: Edward B. Evans, St. Louis; Jimmy L. Droit, St. Peters; Donald D. Porter, Bridgeton, all of Mo.

[73] Assignee: Diagraph Corporation, Herrin, Ill.

[21] Appl. No.: 08/337,300

[22] Filed: Nov. 10, 1994

[51] Int. Cl.[6] ..... B41J 2/04; B41J 2/015

[52] U.S. Cl. ..... 347/54; 347/20

[58] Field of Search ..... 347/54, 20, 50; 335/213–215, 219, 220; 222/1, 146.5, 504; 118/313; 137/516.25, 883, 625.48, 870; 251/129.15, 231, 129.17, 331, 61.1, 84, 85, 333, 357; 361/160, 171, 187, 152; D08/399

[56] References Cited

U.S. PATENT DOCUMENTS

| | | | |
|---|---|---|---|
| 2,712,262 | 7/1955 | Knohl | D08/399 X |
| 2,817,380 | 12/1957 | Knohl | D08/399 X |
| 4,378,564 | 3/1983 | Cross et al. | 347/54 |
| 4,453,652 | 6/1984 | Merkel et al. | 361/154 X |
| 4,555,719 | 11/1985 | Arway et al. | 347/85 |
| 4,576,111 | 3/1986 | Slomianny | 118/313 |
| 4,723,131 | 2/1988 | Droit | 347/54 |
| 4,737,802 | 4/1988 | Mielke | 347/54 |
| 4,792,817 | 12/1988 | Barney | 347/4 |
| 4,819,009 | 4/1989 | Kniepkamp | 347/54 |
| 4,893,101 | 1/1990 | Robitaille | 335/18 |
| 4,924,241 | 5/1990 | Parks et al. | 347/54 |
| 4,985,715 | 1/1991 | Cyphert et al. | 347/54 |
| 5,046,702 | 9/1991 | Miyazawa et al. | 251/129.15 X |
| 5,085,402 | 2/1992 | O'Dell | 251/129.15 X |
| 5,154,394 | 10/1992 | DuHack | 251/129.51 X |

OTHER PUBLICATIONS

Grafstein, Paul and Schwartz, Otto B., "Pictorial Handbook of Technical Devices", Chemical Publishing Co., Inc., New York, pp. 2–3, 1971.

*Primary Examiner*—David F. Yockey
*Attorney, Agent, or Firm*—Senniger, Powers, Leavitt & Roedel

[57] ABSTRACT

A printhead for ink jet printing apparatus having a plurality of orifices for delivery of droplets of ink with delivery controlled by miniature solenoids, one for each orifice, each solenoid having a plunger directly engageable with a membrane to block flow of ink to a respective orifice and electromagnetically retractable from the membrane for flow of ink for delivery of a droplet of ink from the respective orifice, with provision for proportional valve action for each orifice. A removable and replaceable dot mask plate having a pattern of holes is sandwiched between a body and a back plate of the printhead and certain of the plungers of the solenoids are aligned with holes in the dot mask and, in a forward extended position, extend through the holes to engage the membrane. The dot mask masks or blocks other plungers of the printhead.

12 Claims, 11 Drawing Sheets

137
Vcc
LATCH+
LATCH IN+
LATCH-
LATCH IN-
DATA+
DATA IN+
DATA-
DATA IN-
FROM CONTROLLER 135
CLOCK+
CLOCK IN+
CLOCK-
CLOCK IN-
FROM CLOCK 141
EN
/EN
A+
A-
B+
B-
C+
C-
D+
D-
QA
QB
QC
QD
148
Vcc
CLOCK
LATCH
139
Vcc
154
R23
C7
R/C
CEKT
A
B
CLR
Q
/Q
Vcc
ENABLE
149
G
RCK
SRCLR
SRCK
SER
DATA
QA
QB
QC
QD
QE
QF
QG
QH
QH'
DRIVER-1
DRIVER-2
DRIVER-3
DRIVER-4
DRIVER-5
DRIVER-6
DRIVER-7
DRIVER-8
TO DRIVER CONTROL CIRCUITS 143
DATA
145

137A
Vcc
AB-EN
CD-EN
LATCHOUT +
LATCHOUT −
DATAOUT +
DATAOUT −
CLOCKOUT +
CLOCKOUT −
A+
A−
B+
B−
C+
C−
D+
D−
IA
IB
IC
ID
CLOCK
DATA
LATCH
ENABLE
153
Vcc
G̅
RCK
SRCLR
SRCK
SER
QA
QB
QC
QD
QE
QF
QG
QH
QH'
DRIVER-17
DRIVER-18
DRIVER-19
DRIVER-20
DRIVER-21
DRIVER-22
DRIVER-23
DRIVER-24
TO DRIVER CONTROL CIRCUITS 143
DATA
145
139

INK JET PRINTHEAD HAVING SOLENOIDS CONTROLLING INK FLOW

BRIEF SUMMARY OF THE INVENTION

This invention relates to printheads for ink jet printing apparatus and solenoids for such printheads.

Reference may be made to the following U.S. patents relating generally to printheads for ink jet printing apparatus in the same general field as the printhead of this invention:

| U.S. Pat. No. | Issue Date | Title |
|---|---|---|
| 4,555,719 | November 26, 1985 | Ink Valve for Marking Systems |
| 4,576,111 | March 18, 1986 | Marking Jet Discharging Head |
| 4,723,131 | February 2, 1988 | Printhead for Ink Jet Printing Apparatus |
| 4,792,817 | December 20, 1988 | Ink Jet Printing Systems |
| 4,924,241 | May 8, 1990 | Printhead for Ink Jet Printing Apparatus |

Reference is made particularly to U.S. Pat. No. 4,924,241 relating to a printhead for ink jet printing comprising a front plate having a chamber therein for ink under pressure, ports extending from the chamber to the back face of the front plate, recesses in the back face, passages extending through the front plate from the recesses to its front face, the ends of the passages at the front face constituting orifices for delivery of ink onto a target surface moving past the front face, a flexible membrane held on the back face by a back plate, and members slidable in holes in the back plate releasably holding the membrane pressed against the back face of the front plate at the back ends of the ports to block flow of ink out of the back ends of the ports to the recesses and the passages and operable to release the membrane for flexing away from the back ends of the ports for delivery of ink. This invention involves improvements particularly over the printhead disclosed in said U.S. Pat. No. 4,924,241, among the several objects of the invention being noted the provision of a printhead capable of printing with relatively higher resolution at relatively higher speeds, i.e. printing with relatively higher density of dots of ink at relatively higher speeds, e.g. at 2000 cycles per second; the provision of such a printhead with solenoid-controlled valving for orifices through which droplets of ink are delivered onto the target surface for printing in dots thereon, with the moving parts of the valving of relatively low mass for relatively higher speed operation; the provision of such a printhead with relatively low friction in the valving for relatively high speed operation; the provision of such a printhead having relatively closely spaced orifices without use of splayed actuating wires such as wires 53 of the aforesaid U.S. Pat. No. 4,924,241; the provision of such a printhead having valving and control therefor such as to provide for a proportional valve action for each orifice; the provision of a printhead such as described which may be relatively economically manufactured and which is reliable in high speed operation; and the provision of a solenoid particularly for use in the printhead of such construction as to be capable of being miniaturized.

In general, a printhead of this invention for ink jet printing apparatus comprises a body having a front face and a back face, a chamber in the body for ink under pressure, a plurality of ports extending from the chamber to the back face of the body, a plurality of recesses, one for each port, in the back face of the body adjacent but spaced from the end of the respective port at the back face constituting the back end of the port, a plurality of passages, one for each recess, each extending forward from a respective recess through the body to an orifice at the front of the body for delivery of ink onto a target surface moving relative to the body past its front face, a flexible membrane on said back face of the body engageable therewith all around the back end of each said port and each said recess, and means for releasably holding the membrane pressed against the back face of the body around the back end of each said port to block flow of ink from said chamber out of the back end of each said port. The said holding means comprises a plurality of solenoids, one for each of said ports, each solenoid comprising an electromagnetic coil having an axis, a plunger movable in one direction on said axis on energization of the coil, and spring means biasing the plunger in the opposite direction. The holding means further comprises means mounting the solenoids in position at the back face of said body with the axis of each solenoid generally aligned with a respective port and with each solenoid so positioned that when the coil is deenergized the plunger is biased by the spring means in the direction toward the membrane to hold the membrane pressed against the back face of the body around the back end of the respective port to block flow of ink out of the back end of the port, and when the coil is energized the plunger is retracted to release the membrane for flexing away from the back end of the respective port for delivery of ink therefrom to the respective recess, and thence via the respective passage to and out of the respective orifice.

In general, a solenoid of this invention comprises an elongate casing having an axis extending lengthwise thereof, the casing having a head at one end thereof, the head having a central opening. A bobbin having a tubular barrel and flanges at the ends of the barrel with an electromagnetic coil wound on the barrel, is received in the casing extending axially in the casing with one of its flanges adjacent the head of the casing. This one flange has an annular rim projecting toward and engaging the head of the casing. A plunger is movable axially in the barrel and the central opening in the head of the casing. A washer-type spring is held at its periphery between the annular rim and the head and interconnected at its center with the plunger for biasing the plunger outwardly with respect to the casing, the plunger being moveable inwardly with respect to the casing on energization of the coil.

Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 1:
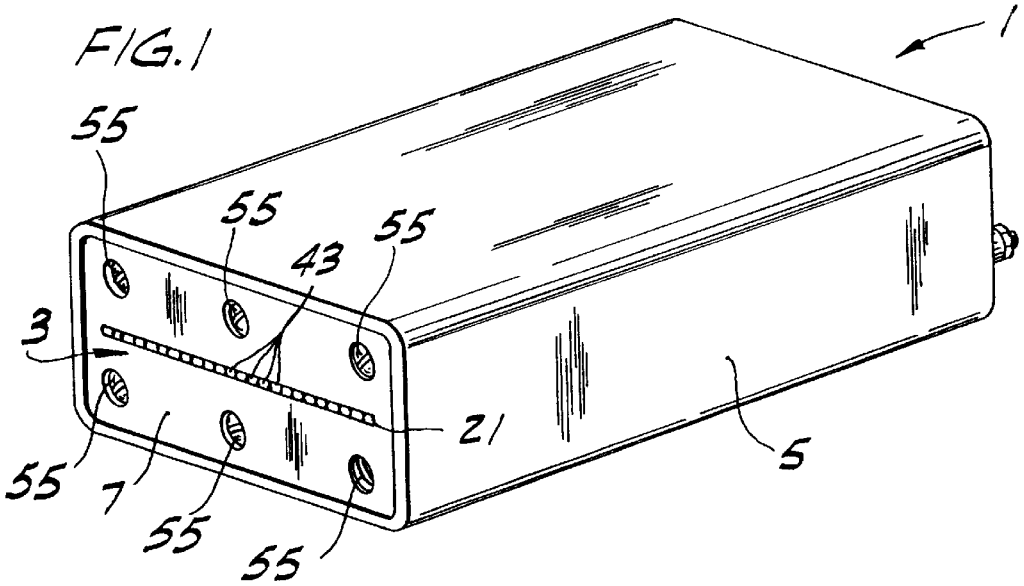
FIG. 1 is a perspective of a printhead of this invention as viewed from one end thereof constituting its forward end.
Figure 4:
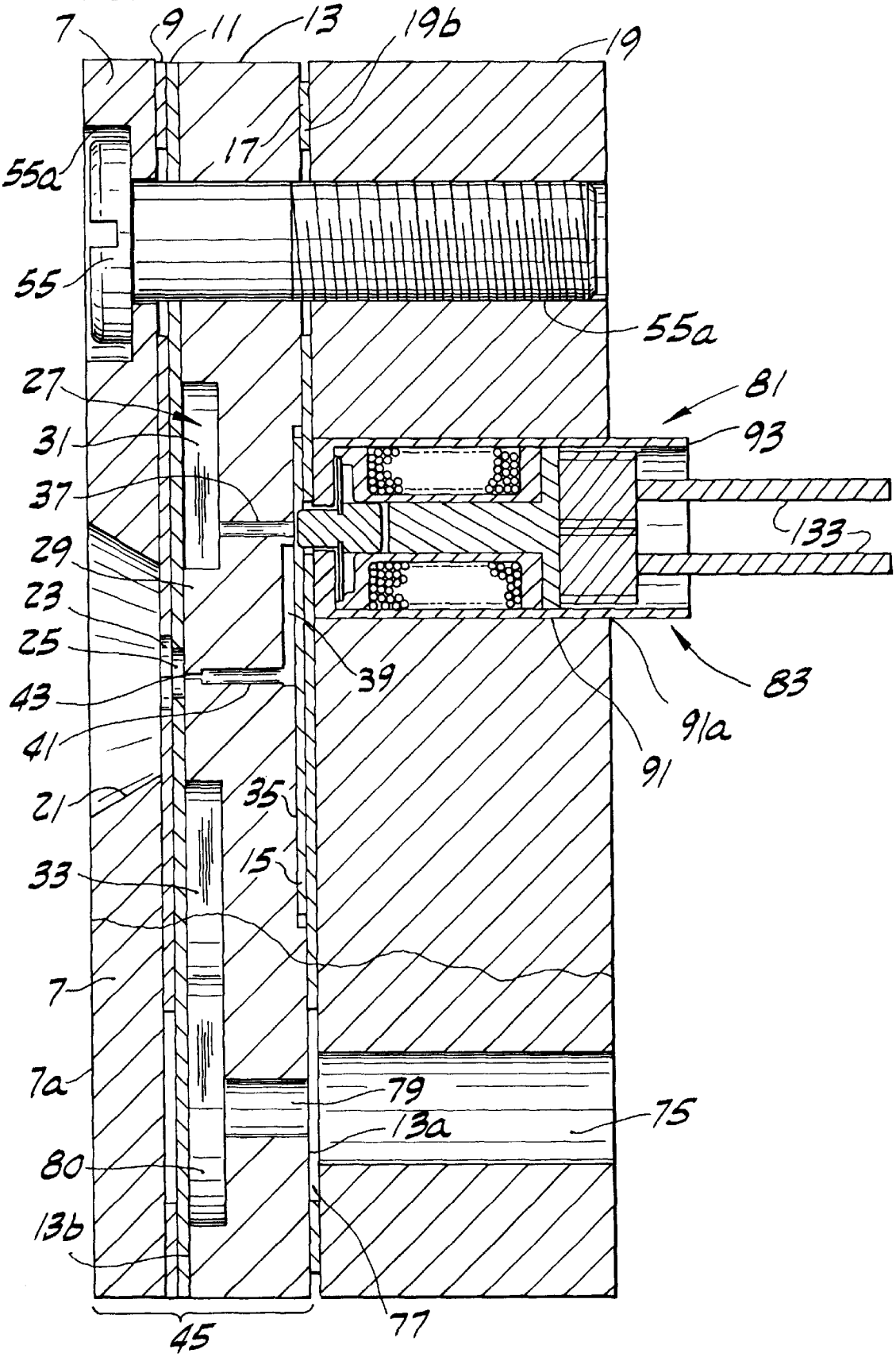
FIG. 4 is a view generally in section on line 4—4 of FIG. 2 showing an assembly of parts constituting what may be referred to as the head of the printhead, on a larger scale than FIG. 2.

Referring to the drawings, an ink jet printhead of this invention, generally designated 1, is shown in FIG. 1 to comprise a head generally designated 3 at the front or forward end of an elongate hollow casing 5 of generally rectangular cross-section. The casing is open at both ends. The head 3 comprises an assembly of seven flat parts 7, 9, 11, 13, 15, 17 and 19 (see particularly FIGS. 4 and 5) sandwiched together as appears in FIG. 4. The first part 7 is constituted by a generally rectangular sheet metal (e.g. stainless steel) plate, referred to as the front plate, having an elongate slot 21 therein extending from a point adjacent one of the narrow ends of the plate to a point adjacent the other narrow end of the plate. The second part 9 is constituted by a generally rectangular relatively thin sheet metal (e.g. stainless steel) plate, generally having the same dimensions as the front plate 7, and having a row of holes 23 therein extending from a point adjacent one of its narrow ends to a point adjacent its other narrow end. As herein illustrated, the plate 9, which is referred to as the orifice mask of the printhead, has twenty-four holes 23 therein, the row of holes being in register with the slot 21 in the front plate 7. The third part 11 is constituted by a generally rectangular relatively thin sheet of gasket material, e.g. EPOM rubber, generally having the same length and width dimensions as the plates 7 and 9. This gasket 11 has a row of twenty-four holes 25, these holes being of somewhat smaller diameter than and in register with the holes 23 in the orifice mask 9. The part 13 is constituted by a generally rectangular plate generally having the same length and width dimensions as parts 7, 9 and 11, but substantially thicker than plate 7, this plate 13 being made of a material capable of being accurately machined and preferably made of a graphite-containing composition such as ET71C graphite. This plate 13, which may be referred to as the orifice plate, has an elongate recess 27 in its front face extending from a point adjacent one of its narrow ends to a point adjacent its other narrow end surrounding an elongate land or boss 29 which rises from the bottom of the recess. This land divides the recess into two parallel channels 31 and 33 extending from a point adjacent one of the narrow ends of the plate 13 to a point adjacent its other narrow end. The recess 27, with its channels 31 and 33, defines a manifold chamber which receives ink under pressure from a source (not shown).

The orifice plate 13 further has an elongate and relatively narrow relatively shallow recess 35 in its back face 13*a* receiving part 15, which is a flexible membrane constituted by a generally rectangular piece of relatively thin flexible elastomeric sheet material. The recess 35 extends generally from end-to-end of the plate 13 and the membrane fits in the recess 35 extending generally from end-to-end thereof with a minimum of space between the side edges of the membrane and the sides of the recess. The plate 13 has a plurality of ports 37 which extend from the manifold chamber 27 to the back face of plate 13, more particularly to the bottom of the recess 35 in the back face of plate 13. As shown, there are twenty-four such ports, twelve extending from channel 31 of the manifold chamber 27 on one side of the land 29 and twelve extending from the channel 33 of the manifold chamber 27 on the other side of the land.

Plate 13 is provided with a plurality of recesses or grooves each designated 39 in its back face in the recess 35 each adjacent but spaced from the end 37*a* of a respective port 37 at the back face in the recess 35 constituting the back end of the port. As shown, there are twenty-four such recesses or grooves, each having an inner end 39*a* adjacent the respective port 37, and each extending away from the port in the direction toward the central longitudinal plane C of the elongate land 29, and having an outer end 39*b* terminating in this plane. The plate 13 further has a plurality of passages 41, one for each port 37 and each recess 39, each extending forward from adjacent the outer end 39*b* of the respective recess 39 through the plate 13 to a relatively small-diameter orifice 43 at the forward or front face 13*b* of the plate 13 for delivery of ink onto a target surface moving relative to the head 3 past its front face, i.e. past the front face 7*a* of plate 7. As illustrated, there are twenty-four passages 41 and twenty-four orifices 43, aligned in a row extending in the central longitudinal plane C of the land 29.

Figure 6:
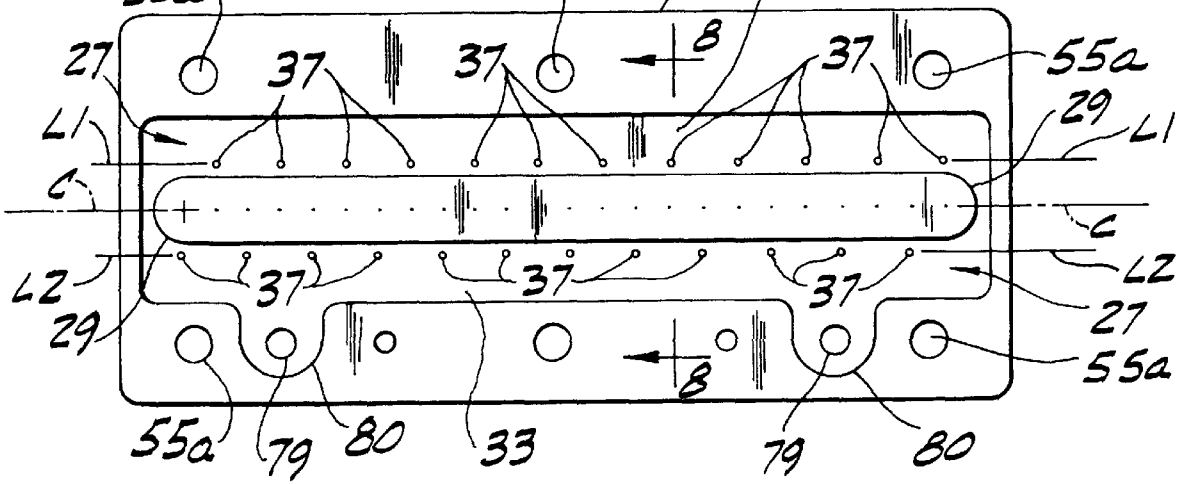
FIG. 6 is an enlarged view from the front of one of said parts shown in FIG. 5, namely, the fourth part from the front of FIG. 5.
Figure 7:
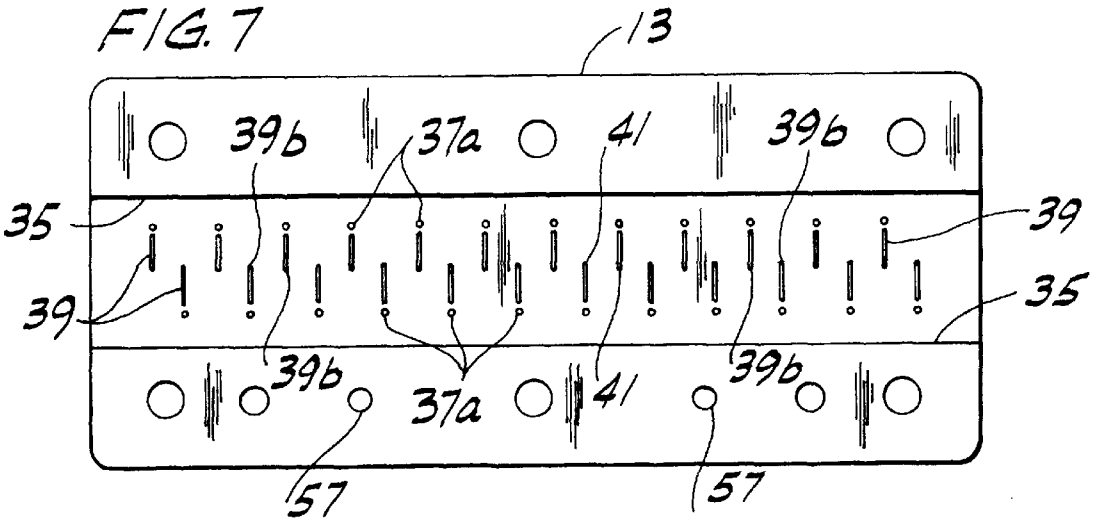
FIG. 7 is a view on the scale of FIG. 6 of the back of the part shown in FIG. 6.
Figure 9:
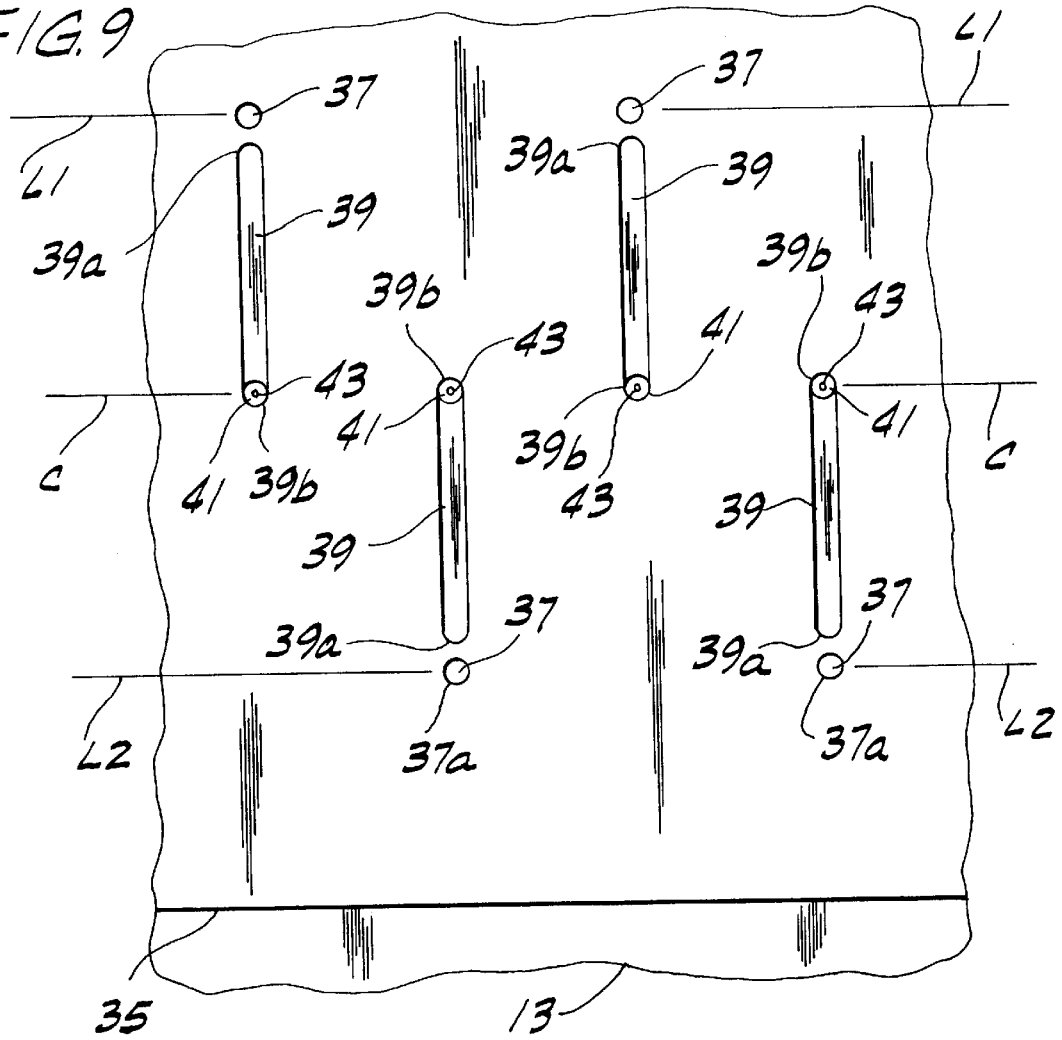
FIG. 9 is an enlarged fragment of FIG. 7.

Thus, the plate 13 has twelve ports 37 having their forward ends spaced at intervals along a line L1 extending lengthwise of the channel 31 on one side of the land 29, and twelve ports 37 having their forward ends spaced at intervals along a line L2 extending lengthwise of the channel 33 on the opposite side of the land 29. The rows of ports 37 on opposite sides of the land are parallel to one another, with the ports 37 in one row staggered with respect to the ports in the other row (see particularly FIG. 6). The twelve recesses 39 of the set of recesses 39 associated with the twelve ports 37 of the first row alternate with the twelve recesses 39 of the set of twelve recesses 39 associated with the twelve ports 37 of the second row. The twelve recesses 39 of the set of recesses 39 associated with the ports 37 of the first row of ports extend in one direction from the adjacent the back ends 37*a* of the ports 37 of the first row toward and terminate at 39*b* at the central plane C of the land 29. The twelve recesses 39 of the other set of recesses 39 extend in the opposite direction toward and terminate at said plane C. The recesses 39 are staggered (as appears in FIG. 7) and each is of such length that their ends 39*b* all lie just past a line in the central plane C of the land 29. Thus, the twenty-four passages 41 lie in said central plane and the twenty-four orifices 43 lie on a line in said plane.

Plates 7, 9, 11 and 13, as assembled constitute what may be referred to as the body 45 (FIG. 4) of the printhead, having a forward or front face 7*a* and a rear or back face indicated at 13*a*, and having said first and second chambers 31 and 33 therein extending parallel to one another on opposite sides of the central plane C of the land 29, which constitutes what may be referred to as the central plane of the printhead. The twelve ports 37 on the same side of the land 29 as the first chamber 31 constitute a first set of said ports extending from the first chamber to the back face 13*a* of the body, the ports 37 of this first set being generally coplanar in a plane including line L1 on said side of the central plane C. The twelve ports 37 on the opposite side of the land 29 constitute a second set of ports extending from the second chamber 33 to the back face 13*a* of the body, the ports of this second set being generally coplanar in a second plane including line L2 on the opposite side of the central plane C. The twelve recesses 39 associated with the back ends 37*a* of the ports 37 of said first set of ports constitute a first set of recesses, each recess of this set extending in one direction generally at right angles to the central plane C from adjacent the back end 37*a* of the respective port 37 toward and somewhat past the central plane C. The twelve recesses 39 associated with the back ends 37*a* of the ports 37 of the second set 49 of ports constitute a second set of recesses, each recess of said second set extending in the opposite direction relative to the recesses of the first set from adjacent the back end 37*a* of the respective port 37 toward and somewhat past the central plane C. The ports and recesses of said first set of ports 37 and said first set of recesses 39 are staggered with respect to the ports and recesses of said second set of ports and said second set of recesses, the recesses of one set extending slightly between and interdigitated with the recesses of the other set.

The part 17, which is referred to as the dot mask of the printhead, is constituted by a relatively thin generally rectangular sheet metal (e.g. stainless steel) plate. The part 19 is constituted by a relatively thick generally rectangular metal (e.g. aluminum) plate, which is referred to as the back plate. The front plate 7, the orifice mask 9, the gasket 11, the orifice plate 13, the membrane 15, the dot mask 17 and the back plate 19 are sandwiched together in that order, with the membrane 15 in the recess 35 in the back face of the orifice plate 13, and held in compressed assembly as by means of screws 55 extending through holes in the parts such as indicated at 55*a*. Parts 7, 9, 11, 13, 17 and 19 are all of the same generally rectangular shape. The membrane 15 is of narrower rectangular shape, having a width related to the width of the recess 35 in the back face 13*a* of the orifice plate 13. The gasket 11 is pressed against the front face 13*b* of the orifice plate 13 to seal recess 27, more particularly to seal both channels 31 and 33. Dowels 56 (see FIG. 5) extending through holes 57 in the parts insure alignment.

Figure 2:
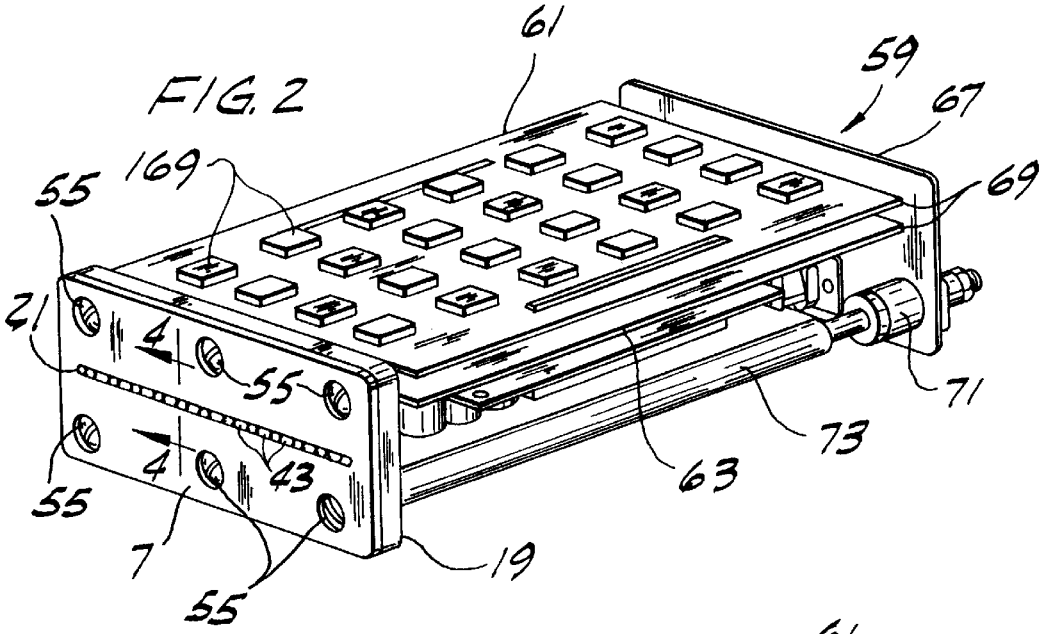
FIG. 2 is a view similar to FIG. 1 with a casing of the printhead removed.
Figure 3:
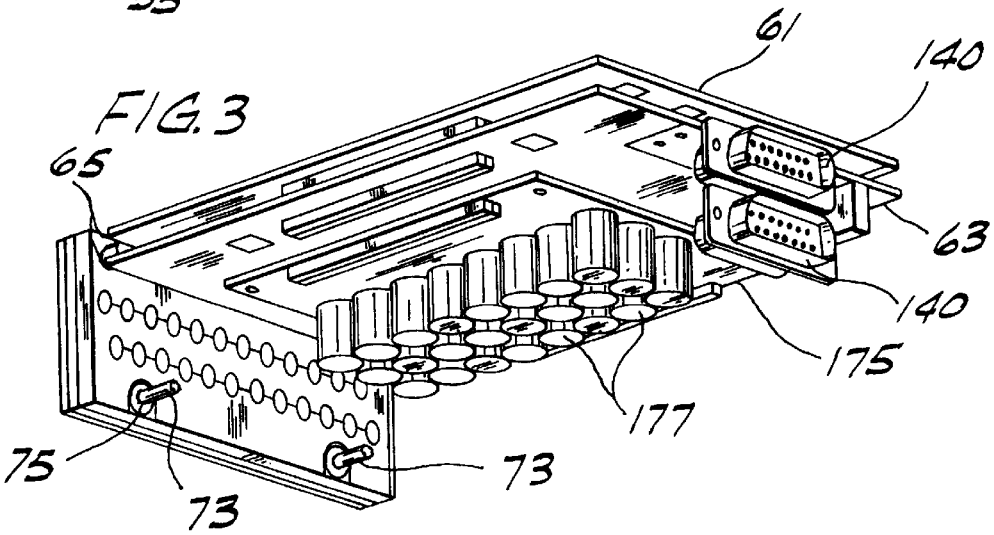
FIG. 3 is a perspective viewed from the rear of and below the printhead with the casing removed and parts omitted.

The head 3 of the printhead is mounted at one end constituting the forward end of a frame 59 (see FIGS. 2 and 3) fitted in the casing 5. This frame comprises a pair of rectangular plates 61 and 63, constituting circuit boards as will appear, closely spaced one above the other, the head 3 being suitably secured where indicated at 65 in FIG. 3 to the plates at one end thereof constituting their forward end with the head 3 extending down the plates as shown in FIGS. 2 and 3. The frame further comprises a back end plate 67 secured where indicated at 69 in FIG. 2 to the rearward ends of plates 61 and 63. This back end plate is omitted in FIG. 3. The printhead is illustrated for expedience in FIGS. 1 and 2 with the row of orifices 43 as if it were horizontal, but it will be understood that the printhead will generally be mounted in a position between that in which the row of orifices 43 is inclined off horizontal at a relatively low angle and that in which the row of orifices is generally vertical for printing characters of different height, the smallest characters being printed with the row of orifices at their lowest angle off horizontal, the largest being printed with the row of characters generally vertical.

Ink under pressure from a source (not shown) is supplied to the channels 31 and 33 via ink fittings such as indicated at 71 in FIG. 2 on the end plate 67 of the frame 59, supply lines such as indicated at 73 in FIGS. 2 and 3 being connected to ports 75 in the back plate 19 which are in communication with the channels via holes 77 in the dot mask 17 and passages 79 in the orifice plate 13. Passages 79 extend from the back face 13*a* of the orifice plate to recesses 80 (FIG. 6) in communication with channel 33 spaced along the length of channel 33.

Figure 10:
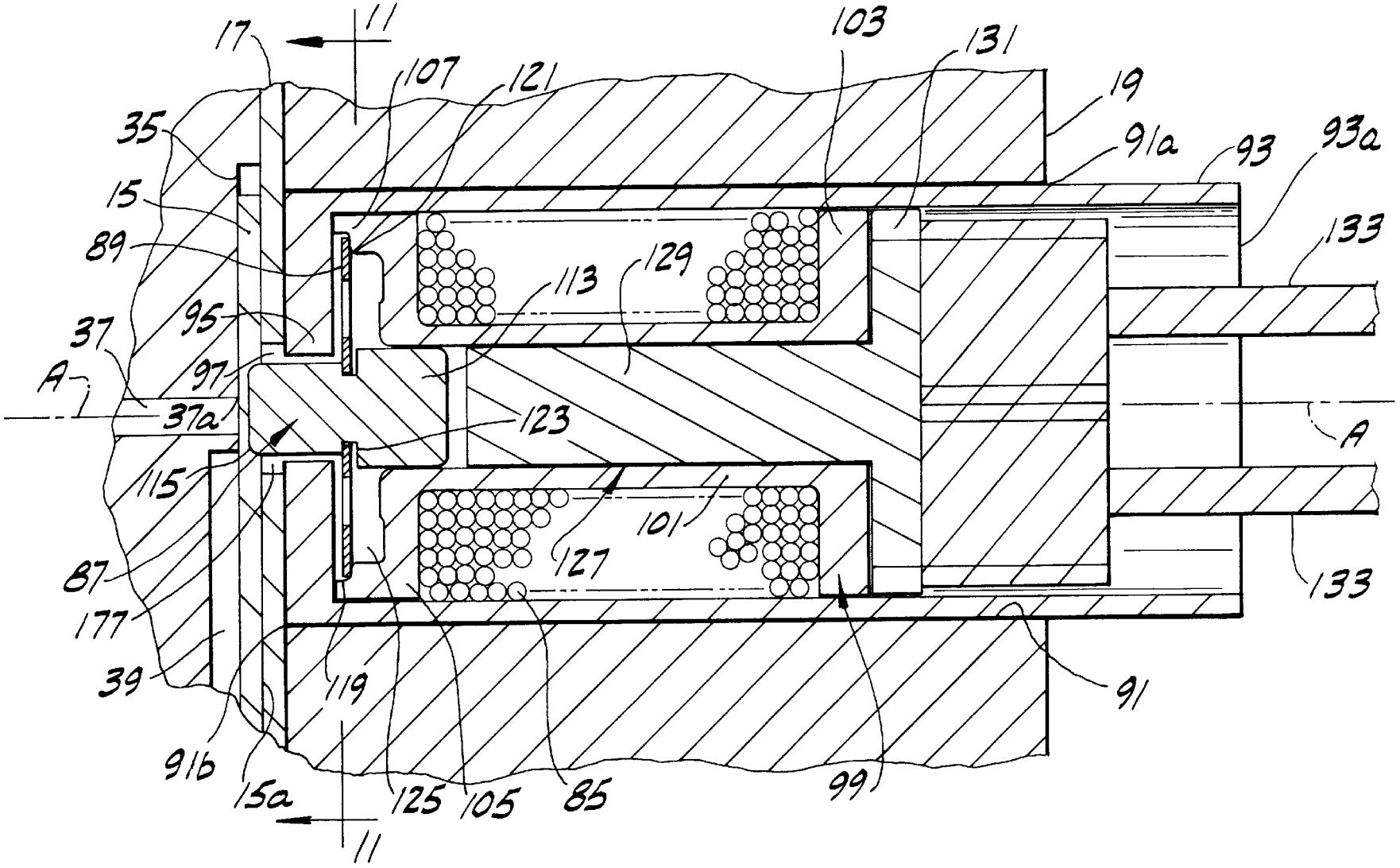
FIG. 10 is an enlarged fragment of FIG. 4.

The back plate 19 carries means indicated generally at 81 for releasably holding the membrane 15 pressed against the back face of the body 45, i.e. pressed against the back face 13*a* of the orifice plate 13 in the recess 35 around the back end of each of the ports 37 to block flow of ink from the respective ink chamber 31 or 33 out of the back end of the port. In accordance with this invention, the membrane holding means comprises a plurality of solenoids, each designated 83, one for each of the ports 37. With twenty-four ports 37 as shown, there are twenty-four solenoids 83. In general as shown greatly enlarged in FIG. 10, each of the solenoids comprises an electromagnetic coil 85 having an axis A, a plunger 87 movable in one direction on said axis (toward the right as viewed in FIGS. 4 and 10) on energization of the coil, and spring means 89 biasing the plunger 87 in the opposite direction (toward the left as viewed in FIGS. 4 and 10). The back plate 19 constitutes means for holding the solenoids 83 in position at the back face 13*a* of the body 45 of the printhead with the axis A of each solenoid generally aligned with a respective port 37 and with each solenoid so positioned that when the solenoid coil 85 is deenergized the plunger 87 is biased by the spring means 89 in the direction toward the membrane 15 to hold the membrane pressed against the back face of the body 45 around the back end of the respective port 37 to block flow of ink out of the back end of the port. When the coil 85 is energized the plunger 87 is magnetically retracted to release the membrane for flexing away from the back end of the respective port 37 for delivery of ink therefrom to the respective recess 39, and thence via the respective passage 41 to and out of the respective orifice 43.

Figure 11:
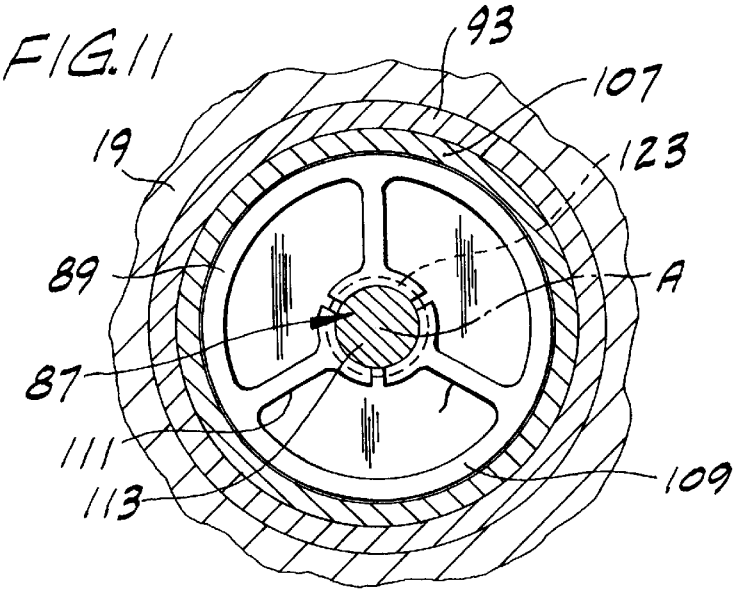
FIG. 11 is a view in section on line 11—11 of FIG. 10.

In further detail, the back plate or back member 19 (constituting the solenoid mounting means of the printhead, secured in position at the back face 13*a* of the body 45 of the printhead) has a plurality of holes each designated 91 therein, one for each of the ports 37 and each generally aligned axially with a respective port 37. Each hole 91 extends completely through the plate 19 from its back face to its front face, each hole thereby having a rear end 91*a* at the back face 19*a* of plate 19 and a forward end 91*b* at the front face 19*b* of plate 19. Each of the twenty-four solenoids 83 is mounted in a respective hole 91 with its plunger 87 movable as above described. Each solenoid comprises an elongate cylindric casing 93 having an axis extending lengthwise thereof coincident with axis A, each casing being received in a respective hole 91 extending lengthwise of the hole and suitably held in the hole as by being press-fitted in the hole. Each casing has a head 95 at one end thereof constituting what is referred to as its forward end, the head having a central opening 97, and is fitted in the respective hole 91 in plate 19 with head 95 at its said forward end at the forward end 91*b* of the hole 91. The coil 85 is wound on a bobbin 99 having a tubular barrel 101 and flanges 103 and 105 extending outwardly at the ends of the barrel. The bobbin, with the coil 85 thereon, is fitted axially in the casing with flange 105 toward the head 95 of the casing and constituting a forward flange on the bobbin, flange 103 being the rearward flange. The flanges have a relatively close fit in the casing. The forward flange 105 has an annular rim 107 extending forward therefrom and engaging the head 95 of the casing. As shown in FIG. 11, the spring means 89 which biases the plunger 87 forward is a washer-type spring having a peripheral ring 109 and spring fingers 111 extending radially inwardly from the ring. The plunger 89 has a rearward end portion 113 of smaller diameter than the internal diameter of the barrel of the bobbin, and a forward end portion 115 of smaller diameter than the rearward end portion which extends forward through a hole 117 in the dot mask 17 for engagement at its forward end with the membrane 15. The rim 107 of flange 105 of the bobbin has an internal annular recess 119 at its forward end forming a forwardly facing step 121, the ring 109 of the spring 89 being received in this recess between the step 121 and the forward end head 95 of the solenoid casing 93. The plunger has an annular groove 123 receiving the inner ends of the spring fingers 111, the latter biasing the plunger to move forward (toward the left in FIGS. 4 and 10) for pressurized engagement of the forward end of the plunger with a region of the back face 15*a* of the membrane 15 which is aligned with and larger than the back end 37*a* of the respective port 37 to block flow of ink out of the back end of the port. The spring fingers 111 center the plunger with respect to the barrel of the bobbin, for anti-friction purposes. When the solenoid coil 85 is energized, the plunger 89 is magnetically drawn back against the forward bias of the spring fingers 111 to release the membrane for flexing away from the back end 37*a* of the respective port 37 for delivery of ink from the latter to the respective recess 39, and thence via the respective passage 41 and out through the respective orifice 43. It will be observed that the step 121 is spaced forward of the central portion of the flange 105 providing a space 125 between the central portion of the flange and the spring fingers enabling flexing of the fingers. At 127 is indicated a core of magnetically permeable material comprising a stem 129 extending axially forward in the barrel 101 of the bobbin 99 from the rear end of the barrel opposite the head 95 of the casing 93. The stem 129 has a flange or head 131 thereon at its back end engaging the rear flange of the bottom. The stem 129 is shorter than the barrel so that there is space in the barrel at the forward end of the stem for the plunger 87. The rear end 93*a* of the casing 93 is open for passage of leads 133 for the coil 85.

A typical spacing for the orifices 43 is about 0.138". The casing 93 of each solenoid 85 is typically about 0.235" in diameter and 0.465" long. The back plate 19 is typically about 0.400" thick and the holes therein for the solenoids are each typically about 0.239" in diameter. Thus, the solenoids are characterized as being miniature solenoids, being small enough to permit the provision of the two rows of solenoids with twelve solenoids in each row as shown for the two rows of ports 37.

Figure 5:
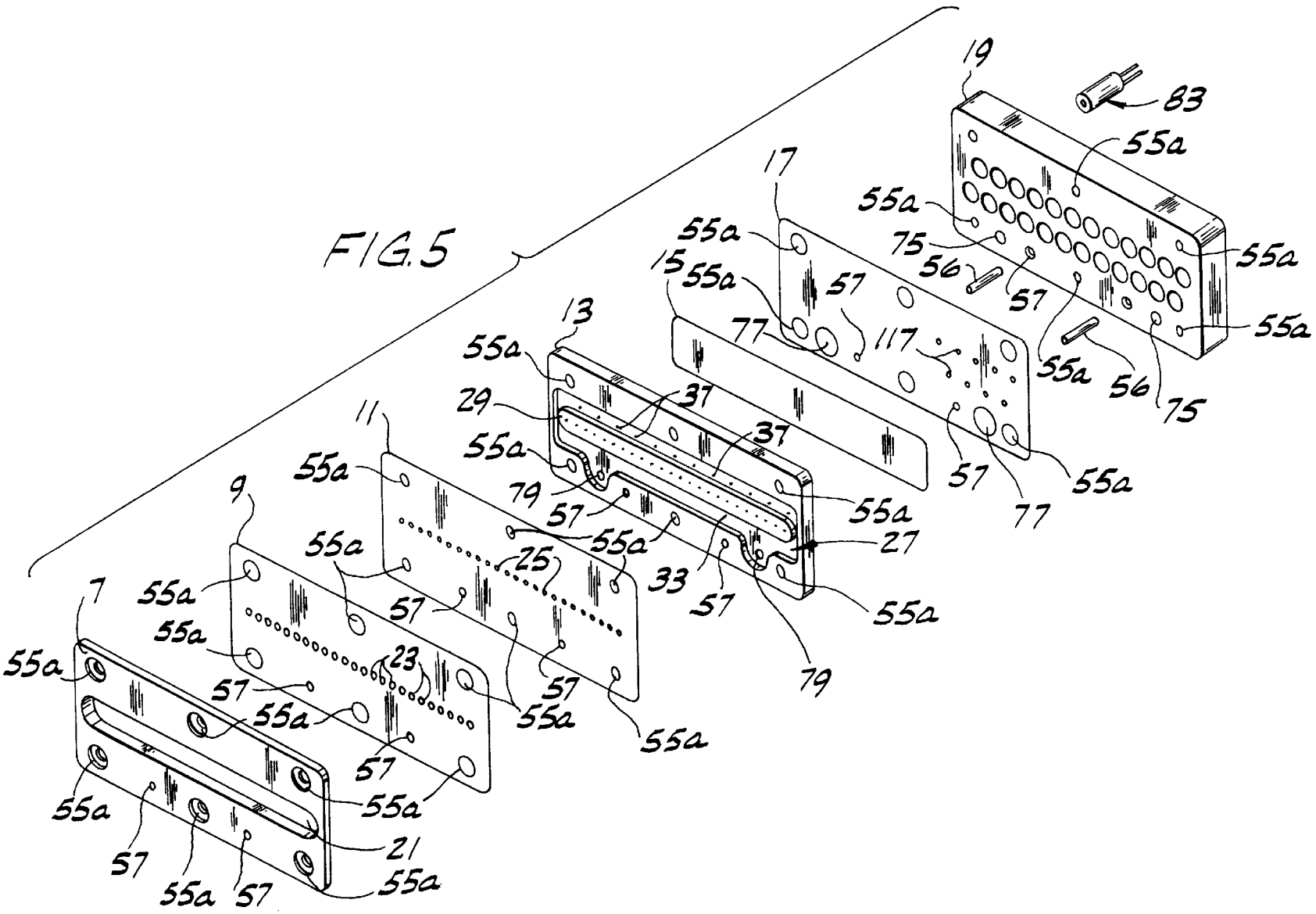
FIG. 5 is an exploded view showing said parts of the head of the printhead.
Figure 8:
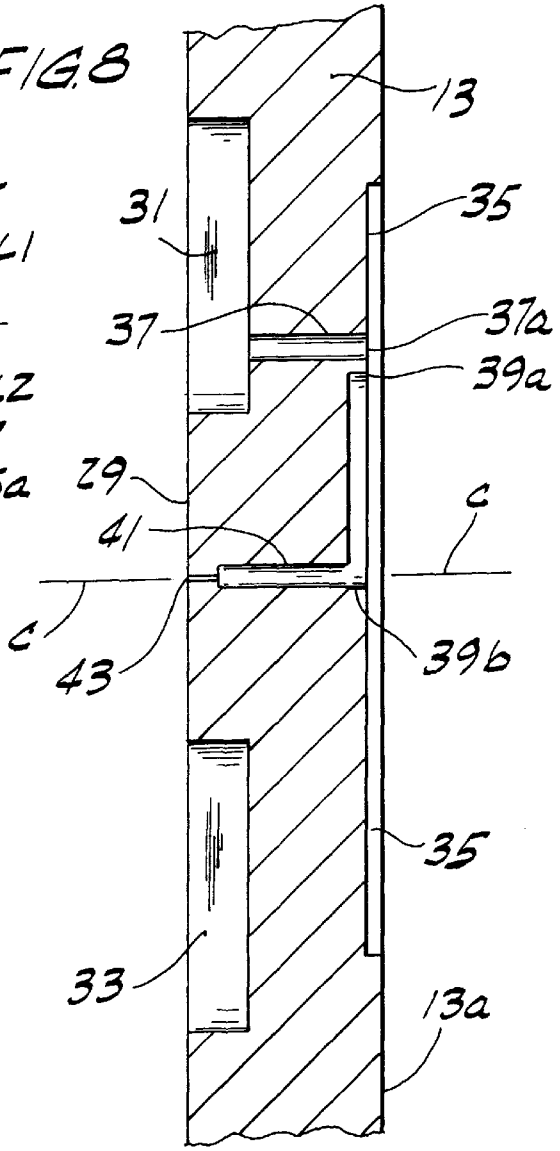
FIG. 8 is an enlarged section on line 8—8 of FIG. 6.

As shown in FIG. 5, by way of example, the dot mask 17 has a set of nine holes 117 which, in the assembly of the parts, register with a set of nine of the holes 91 for nine of the solenoids, and with the nine respective plungers 87 and nine of the respective ports 37, the dot mask thus masking (blocking) the other fifteen plungers. This provides for delivery of ink from a set of nine of the orifices 43. The dot mask is removable and replaceable with other masks with other patterns of holes 117, for operation of the printhead with delivery of ink from other sets of orifices.

The twenty-four orifices 43 at the front face of the land 29 register with the twenty-four holes 25 in the gasket 11, the twenty-four holes 25 register with the twenty-four holes 23 in the orifice mask 9, and the twenty-four holes 23 register with the slot 21 in the front plate 7.

Figure 12:
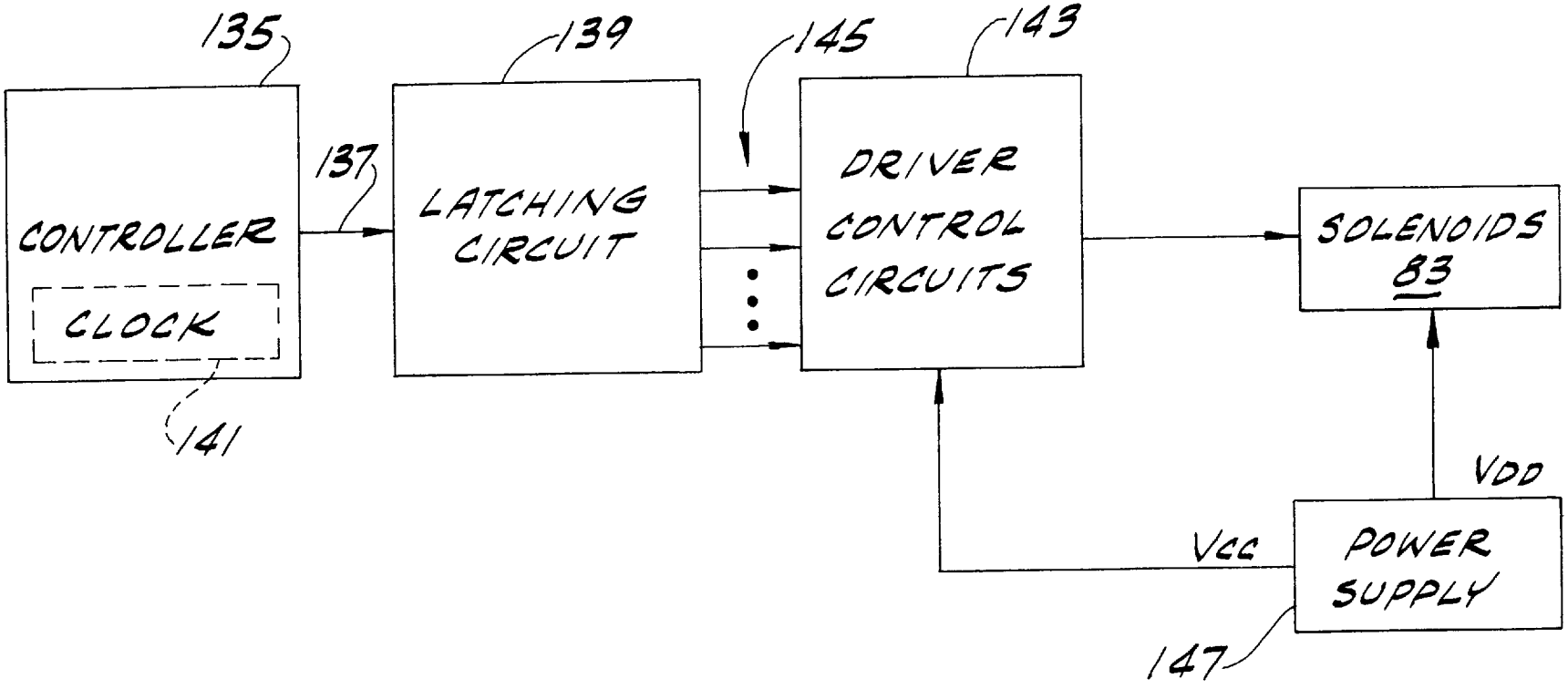
FIG. 12 is a block diagram of electronic circuitry for controlling parts of the printhead including a latching circuit and a driver control circuit.

Referring to FIG. 12, operation of the printhead is under control of a controller 135 which functions to send appropriate signals to solenoids 83 for momentary actuation of one or more selected solenoids 83 to pull back their respective plungers 87. As described above, this allows membrane 15 to flex back away from sealing engagement with the back end of respective port 37 for delivery of ink therefrom to respective recess 39, and thence via respective passage 41 to and out of respective orifice 43.

Controller 135 is of the type disclosed in U.S. patent application Ser. No. 5,606,349, filed Mar. 4, 1994, the entire disclosure of which is incorporated herein by reference. Controller 135 controls the printhead to print specific messages or patterns on, for example, a side of a box (not shown). The pattern may be text, a bar code, a logo, or any other like pattern made up of a number of dots of ink and may be the same on several boxes or specific to the particular box. The printed messages result from instructions provided to controller 135 by some type of input device such as an LC100 hand-held terminal (not shown) or a personal computer (not shown) having a keyboard for permitting an operator to enter messages.

In one preferred embodiment, the controller 135 generates and stores data representative of a "bit map" corresponding to the pattern to be printed. Each dot of ink in the pattern has an address corresponding to respective solenoid 83. According to the invention, controller 135 serially shifts out the bit mapped data via plural line 137 to a latching circuit 139 for holding the data. Preferably, the line 137 includes a pair of corresponding multi-pin connectors, such as indicated at 140 on the frame 59 in FIG. 3, for connecting controller 135 to the latching circuit 139.

In response to a clock signal from a clock 141, latching circuit 139 converts the serial information to parallel information and simultaneously generates driver signals for controlling a plurality of driver control circuits 143. In this embodiment, twenty-four drivers signals are communicated via lines 145 to corresponding driver control circuits 143. Driver control circuits 143 then cause a +27 volt power supply 147 to be connected to coil 85 of each selected solenoid 83. Preferably, latching circuit 139, driver control circuits 143 and solenoids 83 are all resident in the printhead.

Figure 13A:
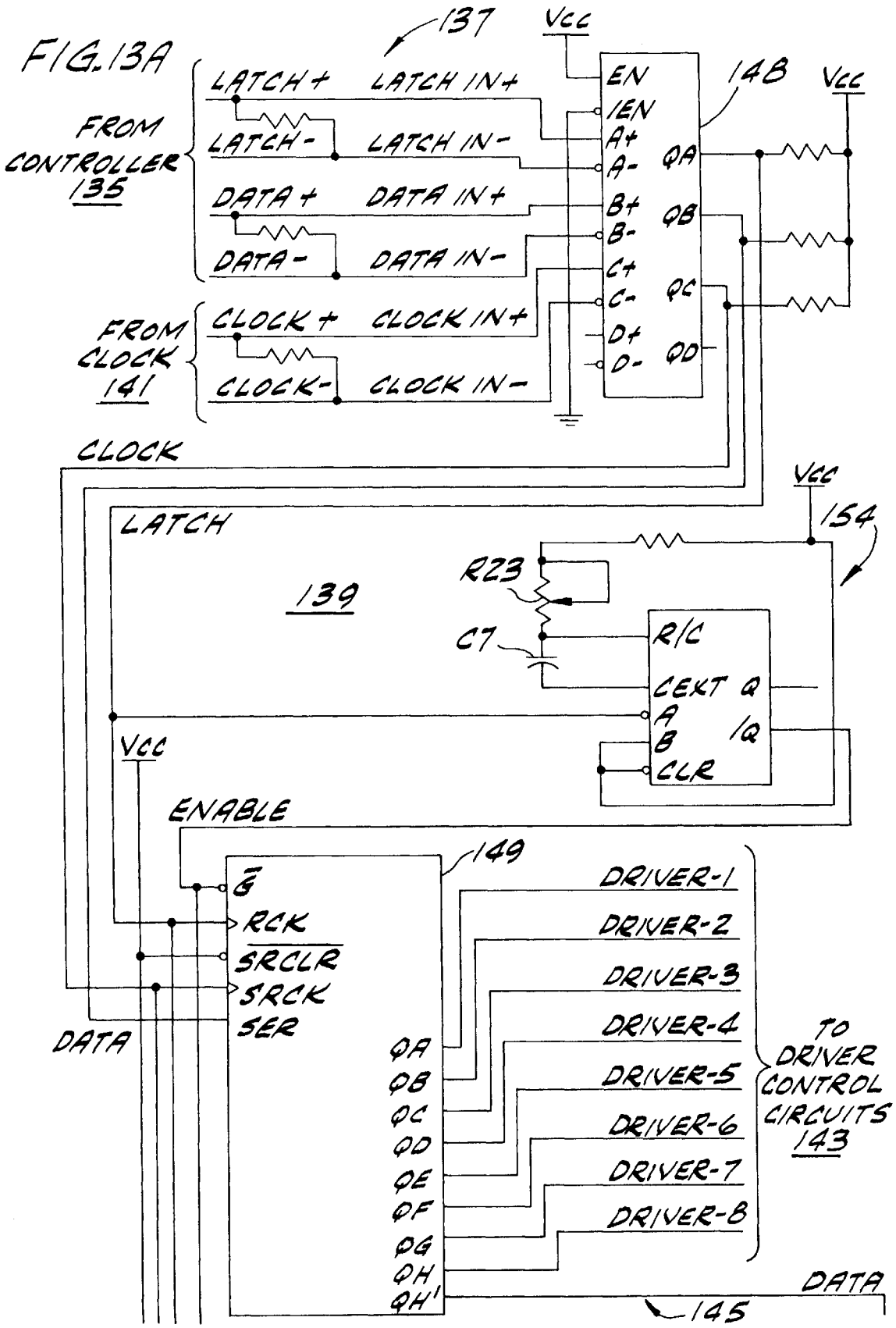
FIGS. 13A–C are schematic diagrams of the latching circuit of FIG. 12.
Figure 13B:
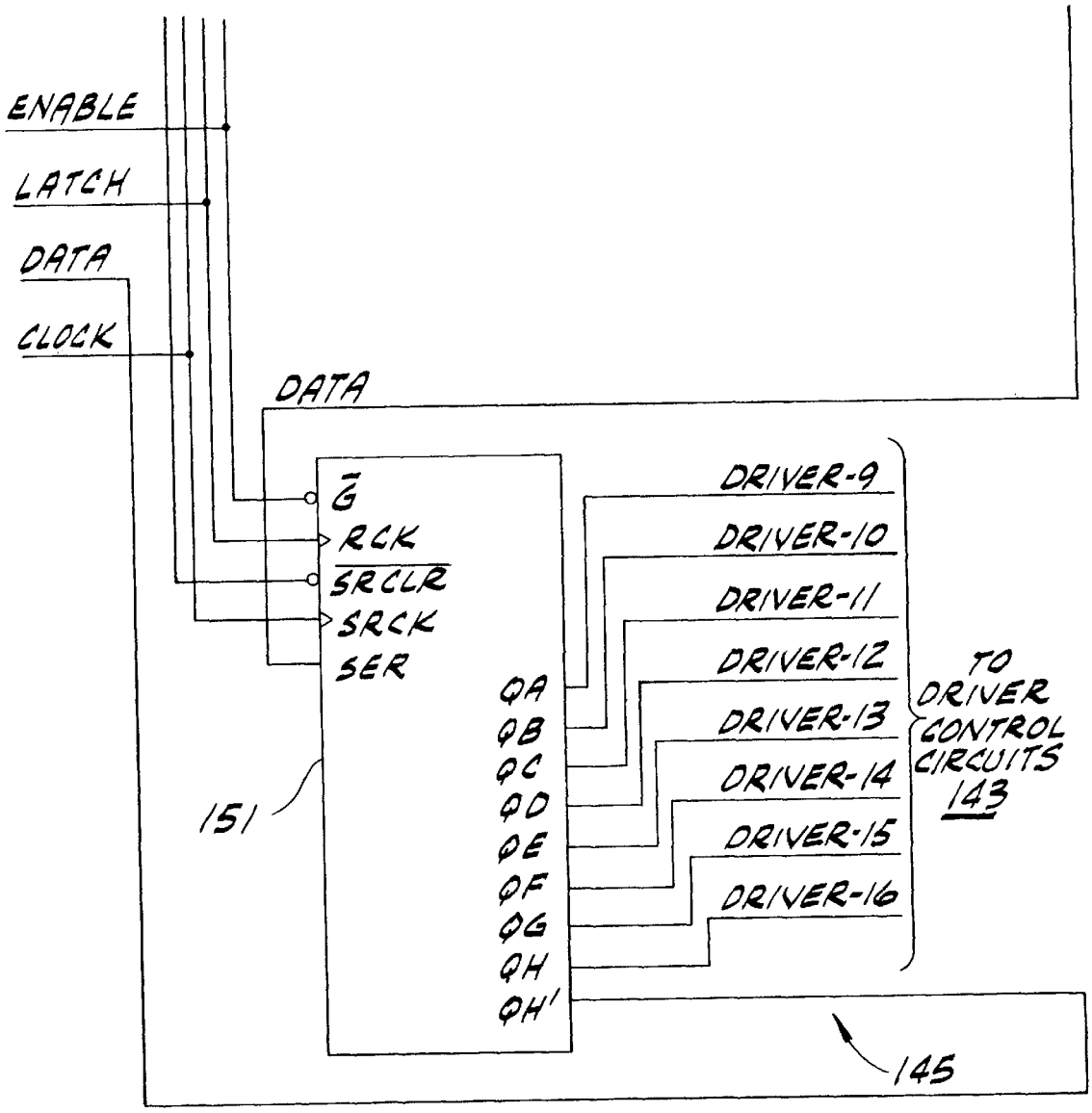
Figure 13C:
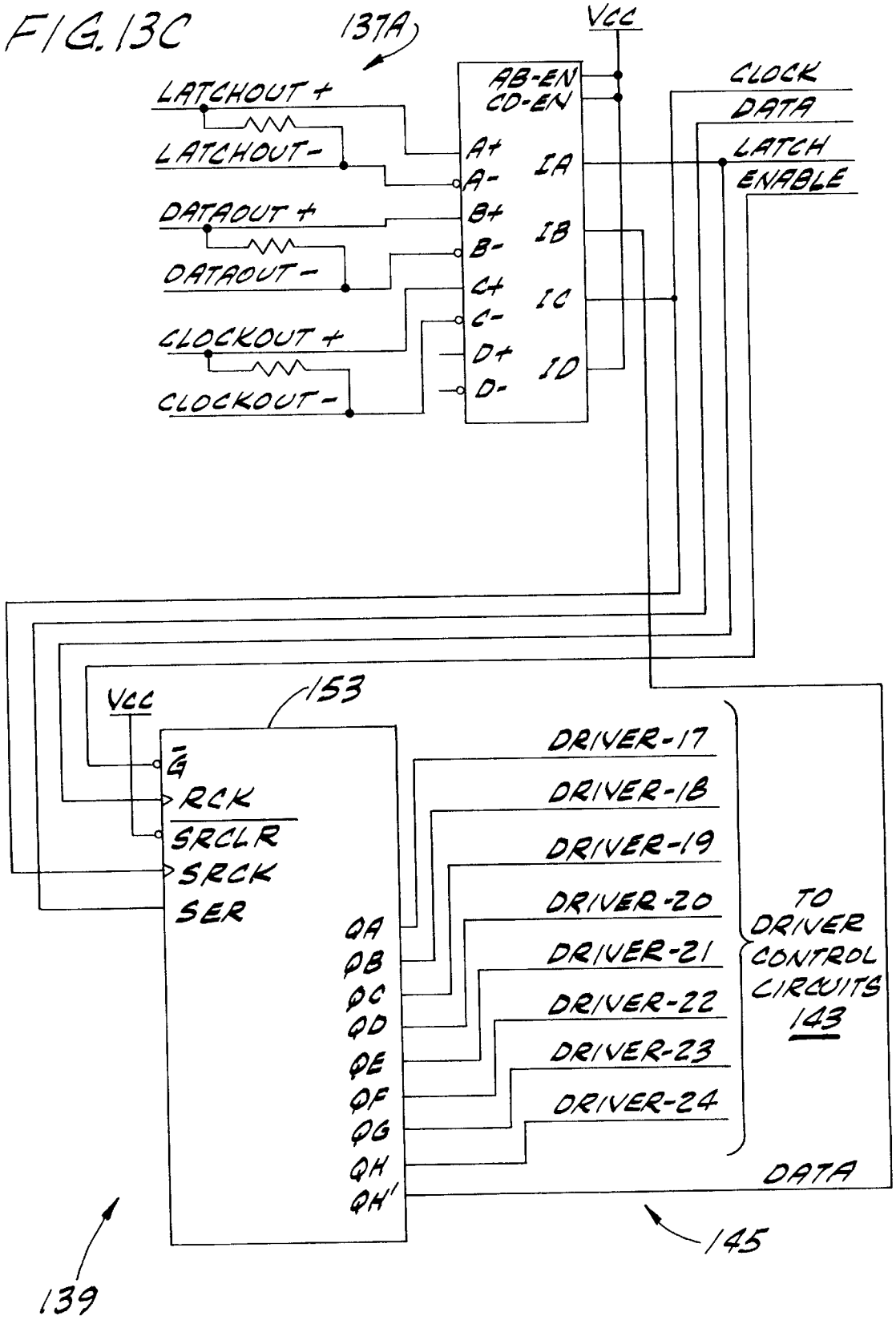

As shown in FIGS. 13A–13C, controller 135 clocks the serial data bit stream (DATA) synchronously into latching circuit 139 via line 137. Line 137 is also used to transmit the clock signal (CLOCK). A serial transmitter 148 converts the differential signals carried by line 137 to logic level signals. When controller 135 has completed clocking in the print data, it sends a latch pulse (LATCH) via line 137. The rising edge of the latch pulse causes latching circuit 139 to hold the data signals in latch registers 149, 151 and 153. The trailing edge of the latch pulse triggers a timer 154 which enables the parallel output of latch registers 149, 151, 153. In response to the clock signal from clock 141, latching circuit 139 releases the latched information in the form of parallel driver signals, DRIVER-1 to DRIVER-24. A logic one turns on a particular driver control circuit 143 to actuate its respective solenoid 83 and a logic zero does not. The timer 154 includes a resistor R23 and a capacitor C7 for determining the amount of time that solenoid 83 is energized thereby setting the size of the dots of ink.

In particular, latch register 149 outputs DRIVER-1 to DRIVER-8, latch register 151 outputs DRIVER-9 to DRIVER-16 and latch register 153 outputs DRIVER-17 to DRIVER-24 depending on which of solenoids 83 are selected for printing. For example, if dots of ink are to be printed at the addresses corresponding to a first, third and twenty-third solenoid 83, then latching circuit 139 generates DRIVER-1, DRIVER-3 and DRIVER-23 logic level high signals. Each of these signals is output via respective line 145 to enable respective driver control circuit 143.

The serial bits provided via signal line 137 may be shifted through one printhead and onto another printhead via line 137A. The number of times that the serial bits are shifted is the sum of all orifices 43 in the printhead chain so that when the shifting stops, each printhead has the proper bits for that printhead. As a result, printheads having different numbers of ink jets or different orifices may be combined together.

Figure 14:
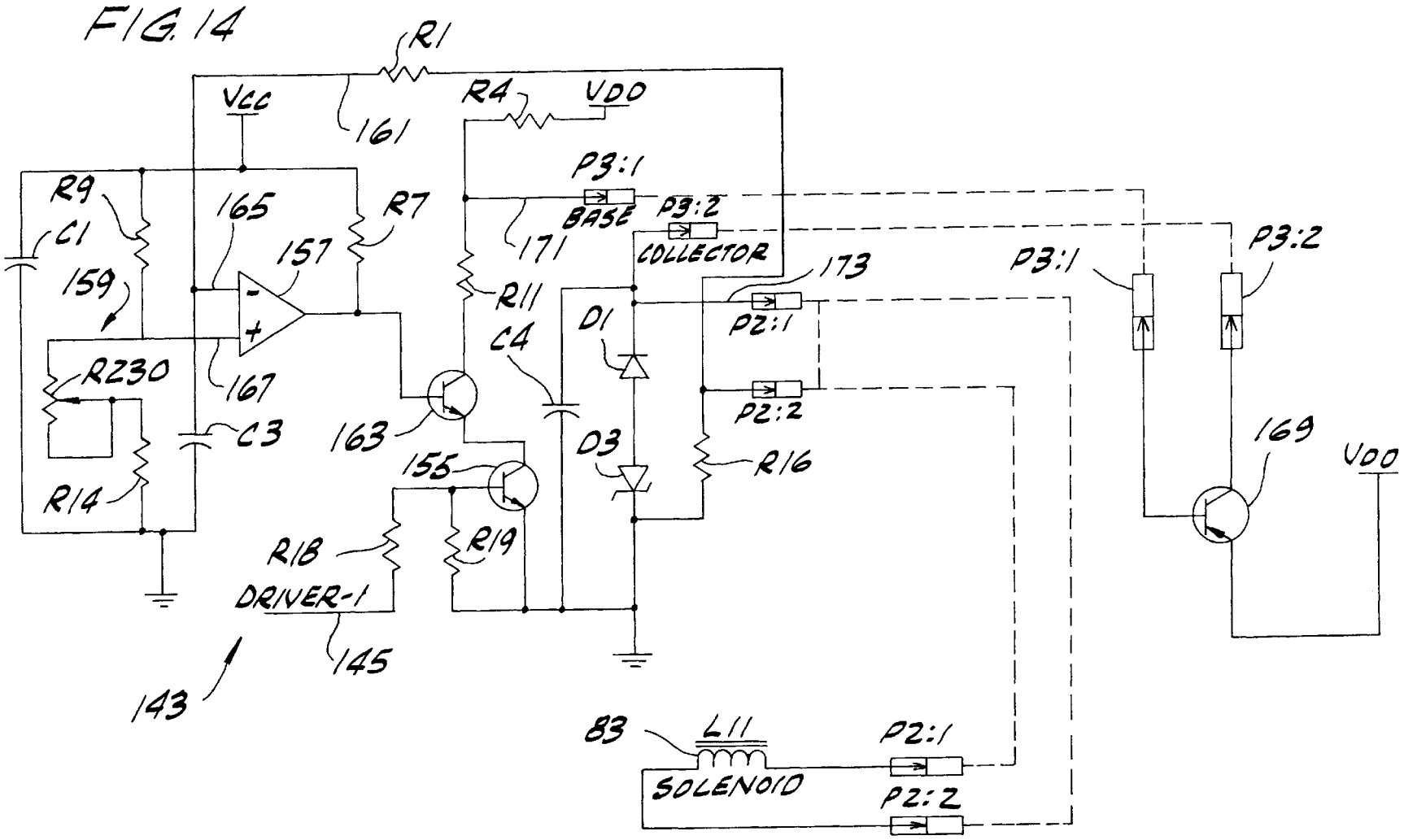
FIG. 14 is a schematic diagram of the driver control circuit of FIG. 12.

FIG. 14 shows a schematic diagram of one preferred embodiment of an exemplary current control circuit comprising driver control circuit 143. All of driver control circuits 143 are essentially identical and each performs a current averaging function by operating in a switching mode. Driver control circuit 143 of FIG. 14 causes its respective solenoid 83 to be energized by a current having a substantially constant average proportional to a reference voltage. This allows the ink jet printing apparatus of the present invention to control the distance that plunger 87 is retracted and, thus, to further control the size of the printed dots.

The driver signal at line 145, e.g., DRIVER-1, enables driver control circuit 143 when it is logic level high by biasing the base of a transistor 155. Otherwise, the base of the transistor 155 is pulled low via a resistor R19 connected to ground so that current is not allowed to flow through coil 85 of solenoid 83. Once enabled, driver control circuit 143 selectively connects a voltage source VDD to coil 85 as a function of the reference voltage thereby energizing solenoid 83. For the particular driver control circuit 143 illustrated in FIG. 14, current is provided to solenoid 83 via pins P2:1 and P2:2.

Power supply 147 preferably includes a voltage regulator for providing a logic supply voltage VCC to driver control circuit 143 in addition to providing supply voltage VDD. A comparator 157 included in driver control circuit 143 compares VCC to the reference voltage. Driver control circuit 143 further includes a potentiometer circuit 159 comprised of a variable resistor R230 for determining the magnitude of the current provided to solenoid 83 for energizing respective coil 85. By adjusting the resistance of the potentiometer circuit 159, the reference voltage is varied.

A resistor R16, connected in series with solenoid 83, senses the energizing current in coil 85 and a feedback loop 161 feeds the current back to comparator 157. A transistor 163 cooperates with comparator 157 so that the current provided to solenoid 83 is turned on and off as a function of the comparison.

As described above, driver control circuit 143 is a current averaging circuit for maintaining a constant average current. After drive control circuit 143 is enabled, the current in respective coil 85 of respective solenoid 83 rises until the supply voltage applied at an input 165 of comparator 157 reaches the reference voltage applied at an input 167. Driver control circuit 143 then disconnects solenoid 85 from power supply 147 and allows the current to decay. After the current decays to a predetermined value, it is turned back on and allowed to rise until the voltage at input 165 again reaches the reference voltage at input 167.

Referring further to FIG. 14, a high driver signal enables driver control circuit 143 and causes transistor 163 to conduct. In turn, the base of a pnp driver transistor 169 is biased at line 171. The driver transistor 169 has a high impedance and remains off when transistor 155 is off. Thus, current does not flow in coil 85 or in a current sensing resistor R16. According to the invention, input 165 is at zero volts and input 167 is at 0.7 volts when transistor 155 is off. This causes the output of comparator 157 to be high at the base of transistor 163. Thus, once DRIVER-1 goes high and enables transistor 155, transistor 163 also turns on. As a result, driver transistor 169 turns on and connects supply voltage VDD to the high side of solenoid 83 at line 173 causing current to flow through coil 85 and resistor R16. In one preferred embodiment, the value of resistor R16 is selected so that when the current in R16 exceeds approximately 0.35 amps, the resistive voltage drop is greater than 0.7 volts. For example, R16=2 ohms. This voltage drop is applied to input 165 via feedback loop 161 causing the output of comparator 157 to be logic level low. As a result, transistor 163 turns off which in turn causes driver transistor 169 to turn off.

After driver transistor 169 disconnects VDD from solenoid 83, the collapsing field in coil 85 causes current to continue through coil 85. This current circulates through resistor R16 as well as diodes D3 and D1 and then back to solenoid 83. As the current slowly decays, the voltage drop across resistor R16 becomes less than 0.7 volts at which time the output of comparator 157 goes high to turn on transistor 163. In turn, driver transistor 169 reconnects solenoid 85 to supply voltage VDD. Driver transistor 169 switches on and off at a particular frequency to maintain an average current in coil 85 at a substantially constant magnitude of 0.35 amps until transistor 155 is turned off.

FIG. 14 further illustrates a capacitor C4 for reducing electrical noise generated by the collapsing field of coil 85. When driver transistor 169 turns off, capacitor C4 provides a path for the current from the collapsing field until diodes D3 and D1 have time to begin conducting. A pair of resistors R9 and R14 form a voltage divider circuit for setting the reference voltage at input 167. A capacitor C1 functions as a bypass filter capacitor. As shown, the voltage divider circuit is adjustable by varying the resistance of potentiometer circuit 159.

The output of comparator 157 is an open collector circuit requiring a resistor R7 to pull up the line between the output of comparator 157 and the base of transistor 163. A resistor R18 limits the base current of transistor 155 and a resistor R11 limits the base current of driver transistor 169. A resistor R4 holds the base of driver transistor 169 at VDD when either transistor 163 or transistor 155 is off.

Advantageously, solenoid driver circuit 143 maintains current in coil 85 below a magnitude at which would cause saturation of the magnetic core 127 of solenoid 83. Thus, a relative high VDD is possible for obtaining a maximum operating speed without excessive losses due to heat dissipation in solenoid 83.

By pulsing the current provided to solenoid 83, driver control circuit 143 energizes coil 85 with a current having a sawtooth-type waveform with a substantially constant average magnitude over time. In a preferred embodiment, each "sawtooth" represents a cycle of operation of solenoid 83 wherein the average current of each cycle of the waveform is substantially constant. Plunger 87 retracts as the current in coil 85 ramps to a maximum value and returns to its original position after the current is turned off and it decays to a minimum value. Although the current waveform is referred to as being a sawtooth, it is to be understood that the ramp and decay portions of the waveform are not necessarily linear.

Driver control circuit 143 maintains a constant average current by means of a feedback circuit including feedback loop 161 and comparator 157. In this manner, driver control circuit 143 controls the distance that plunger 87 is retracted and, thus, the ink flow rate, which is proportional to the current. In one preferred embodiment of the invention, driver control circuit 143 maintains a current between 0.25 amps and 0.50 amps by adjusting respective potentiometer 159. As a result, the printhead produces ink dots having diameters between 0.03 inches and 0.07 inches. A preferred dot size is 0.04 inches. Each of the twenty-four driver control circuits 143 are tuned by adjusting respective potentiometer 159 so that solenoids 83 produce uniform dots of ink. Thus, solenoids 83 essentially function as proportional valves.

A global potentiometer (not shown) is used to generally vary dot size after each of the driver control circuits 143 is tuned. It is to be understood that this range may be varied according to the particular application in which the printhead of the invention is to be used.

Solenoid 83, shown in FIG. 14 as an inductor having two lead wires, is plugged into a two-pin connector (not shown). The two-pin connector is soldered onto plate 63 constituting a multi-pin circuit board. As such, driver transistor 169 is isolated from both driver control circuit 143 and solenoid 83 so that they are protected from power surges and the like. The plate 61, as shown in FIG. 2, is a circuit board carrying driver transistors 169. A circuit board 175 (see FIG. 3) is mounted below plate 63 on the frame 59 carrying capacitors 177 connected in parallel for filtering supply voltage VDD.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A printhead for ink jet printing apparatus comprising a body having a front face and a back face, a chamber in the body for ink under pressure, a plurality of ports extending from the chamber to the back face of the body, each of said ports having a back end at the back face of the body, a plurality of recesses, one for each of said ports, in the back face of the body adjacent but spaced from said back end of the port, a plurality of passages, one for each recess, each of said passages extending forward from a recess through the body toward the front of the body, a plurality of orifices at the front face of the body, one orifice for each of said passages, each of said passages extending forward through the body to an orifice for delivery of ink from the orifices onto a target surface moving relative to the body past said front face of the body, a flexible membrane on said back face of the body engageable therewith all around the back end of each of said ports and each of said recesses, and means for releasably holding the membrane in position pressed against the back face of the body around the back end of each of said ports to block flow of ink from said chamber out of the back end of each of said ports, said holding means comprising a plurality of solenoids, one for each of said ports, each of said solenoids comprising an electromagnetic coil having an axis, a forward end, a rearward end, a plunger movable within the coil on the axis of the coil and spring means for biasing the plunger in a forward direction, said plunger having a free end adjacent the said forward end of the solenoid constituting the forward end of the plunger, said plunger being movable axially within the coil of the solenoid between a forward extended position wherein said plunger extends forward from the forward end of the solenoid and a rearward retracted position spaced rearward from said forward extended position, the plunger being movable rearward against said spring bias on energization of the coil, means for mounting the solenoids in position at the back face of said body with the axis of each of said solenoids and each of said plungers generally aligned with a respective port of said plurality of ports and with the forward end of each of said solenoids proximate said membrane, each of the solenoids being so positioned at the backface of said body and each of the plungers being so disposed in the coil of the solenoid that when the coil of the solenoid is deenergized the plunger is in extended position with said free end of said plunger engaging the membrane and holding the membrane pressed under the bias of said spring means against the back face of the body around the back end of the respective port of said plurality of ports to block flow of ink out of the back end of the port, and when the coil is energized the plunger is retracted to release the membrane for flexing away from the back end of the respective port of said plurality of ports for delivery of ink therefrom, wherein the membrane has a front face in engagement with the back face of said body and a back face, wherein the printhead has a masking plate on the back face of the membrane, said masking plate having holes therein in a pattern for alignment with certain of the ports in the body, wherein said body has a predetermined thickness and the solenoid mounting means comprises a back plate of substantially greater thickness than that of said body removably assembled with the body at the back face of the body with the membrane and the masking plate sandwiched between the body and said back plate, said back plate having a plurality of holes therein, one for each of said ports, each of said holes in said back plate being aligned with a said respective port of said plurality of ports, each of said solenoids being mounted in a respective hole of said plurality of holes with the plunger of each of said solenoids movable toward and away from the back face of the membrane aligned with the back end of the said respective port, each of said plungers being biased in said forward direction by the spring means therefor, certain of said plungers being aligned with the holes in said masking plate and in the forward extended position thereof extending through the respective hole of said plurality of holes in the masking plate and engaging the membrane through said respective hole of said plurality of holes in the masking plate to press the membrane against the back face of the body around the said respective port of said plurality of ports to block flow of ink out of the back end of the port, the plunger being retracted on energization of the coil to release the membrane for flexing away from the back end of the said respective port of said plurality of ports for delivery of ink therefrom to the respective recess of said plurality of recesses, and thence through the respective passage of said plurality of passages to and out of the respective orifice of said plurality of orifices, said masking plate being removable and replaceable with another masking plate having a different pattern of holes.

2. A printhead as set forth in claim 1 wherein each of the solenoids comprises an elongate casing having an axis extending lengthwise thereof, the coil of the solenoid being received in the casing coaxially therewith, the plunger of the solenoid being movable axially with respect to the coil and casing into and out of one end of the casing constituting the forward end of the casing, said spring means being interconnected between the casing and the plunger within the casing and biasing the plunger to move in said forward direction out of said forward end of the casing, each of said solenoids having the casing thereof fitted in a respective hole in the back plate with said forward end of the casing at the front end of said respective hole.

3. A printhead as set forth in claim 2 wherein, as to each solenoid, the coil is wound on a bobbin having a tubular barrel having opposite ends and flanges extending outwardly at said ends of the barrel, the flanges fitting in the casing, the flange at one end of the barrel constituting a forward flange and the flange at the other end of the barrel constituting a rearward flange.

4. A printhead as set forth in claim 3 wherein, as to each solenoid, the casing has a head at said forward end thereof toward the body, the plunger being axially movable in an opening in said head and in the tubular barrel of the bobbin.

5. A printhead as set forth in claim 4 wherein, as to each solenoid the bobbin is received in the casing with said forward flange thereof adjacent the head of the casing, said forward flange having an annular rim projecting toward and engaging the head of the casing.

6. A printhead as set forth in claim 5 wherein, as to each solenoid, the spring means comprises a washer-type spring having a periphery and a center held at said periphery thereof between said annular rim and said head of the casing and interconnected at said center thereof with the plunger.

7. A printhead as set forth in claim 6 wherein said washer-type spring comprises a peripheral ring and spring fingers extending radially inwardly from the ring, the plunger having an annular groove, the fingers having inner ends received in the groove.

8. A printhead as set forth in claim 7 wherein the barrel has an internal diameter and the plunger, where movable in the barrel, is of circular cross-section of smaller diameter than the internal diameter of the barrel and the spring fingers are of equal length so as to center the plunger in the barrel for anti-friction purposes.

9. A printhead as set forth in claim 8 wherein said annular rim projects toward and has an outer end engaging the head of the casing, said rim having an internal annular recess at said outer end thereof, said washer-type spring having the periphery thereof received in said internal annular recess.

10. A printhead as set forth in claim 3 having a magnetic core in the barrel of the bobbin.

11. A printhead as set forth in claim 10 wherein the magnetic core comprises a stem extending axially in the barrel of the bobbin from the end of the barrel opposite the head of the casing, the stem having a flange thereon at the back end thereof engaging the rearward flange of the bobbin.

12. A printhead as set forth in claim 11 wherein, as to each solenoid, the casing has a back end and is open at said back end and the solenoid has terminals for the coil extending back out of the back end of the casing.

* * * * *